United States Patent [19]

Schaefer

[11] Patent Number: 5,039,974

[45] Date of Patent: Aug. 13, 1991

[54] PROTECTIVE CAP FOR ROTATABLY-ADJUSTABLE ELECTRONIC COMPONENTS

[75] Inventor: Henry A. Schaefer, Lynchburg, Va.

[73] Assignee: Ericsson Ge Mobile Communications Inc., Lynchburg, Va.

[21] Appl. No.: 495,800

[22] Filed: Mar. 19, 1990

[51] Int. Cl.[5] ..... H01C 10/32

[52] U.S. Cl. ..... 338/163; 338/162; 338/170; 338/171

[58] Field of Search ..... 338/160–175

[56] References Cited

U.S. PATENT DOCUMENTS

| | | | |
|---|---|---|---|
| 2,639,358 | 5/1953 | Budd et al. . | |
| 2,745,927 | 5/1956 | Daily et al. . | |
| 2,829,224 | 4/1958 | DeBell . | |
| 3,237,140 | 2/1966 | Barden et al. . | |
| 3,350,673 | 10/1967 | Spaude . | |
| 3,355,693 | 11/1967 | Benthuysen et al. . | |
| 3,377,606 | 4/1968 | Ferrell . | |
| 3,413,588 | 11/1968 | Ferrell | 338/174 |
| 3,470,519 | 9/1969 | Hatch | 338/162 |
| 3,748,626 | 7/1973 | Maurice | 338/162 |
| 3,760,324 | 9/1973 | Baldwin et al. | 338/174 |
| 4,206,334 | 6/1980 | LaRock | 200/291 |
| 4,649,366 | 3/1987 | McDonald | 338/134 |
| 4,654,625 | 3/1987 | Bentz et al. | 338/164 |
| 4,774,490 | 9/1988 | Azuchi | 338/160 |

*Primary Examiner*—Marvin M. Lateef

*Attorney, Agent, or Firm*—Nixon & Vanderhye

[57] ABSTRACT

A protective cap for a rotatably-adjustable electrical component mounted to a PW board in an enclosed electronic control unit. The housing of the electronic control unit has a tuning access hole axially aligned with a tapered lead-in port in the center of the protective cap. An adjustment tool is inserted into the tuning access hole and guided into a tuning slot in the adjustable electrical component by the tapered lead-in port in the cap. The cap also protects the rotatable component from damage by a poorly-aimed adjustment tool. The several caps covering the rotatable components on a board as well as the access openings of the housing may be color-coded to assist in component identification.

15 Claims, 1 Drawing Sheet

FIG. 1
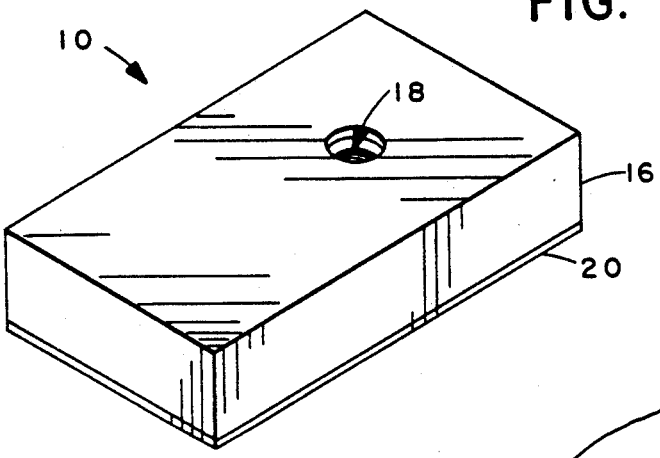
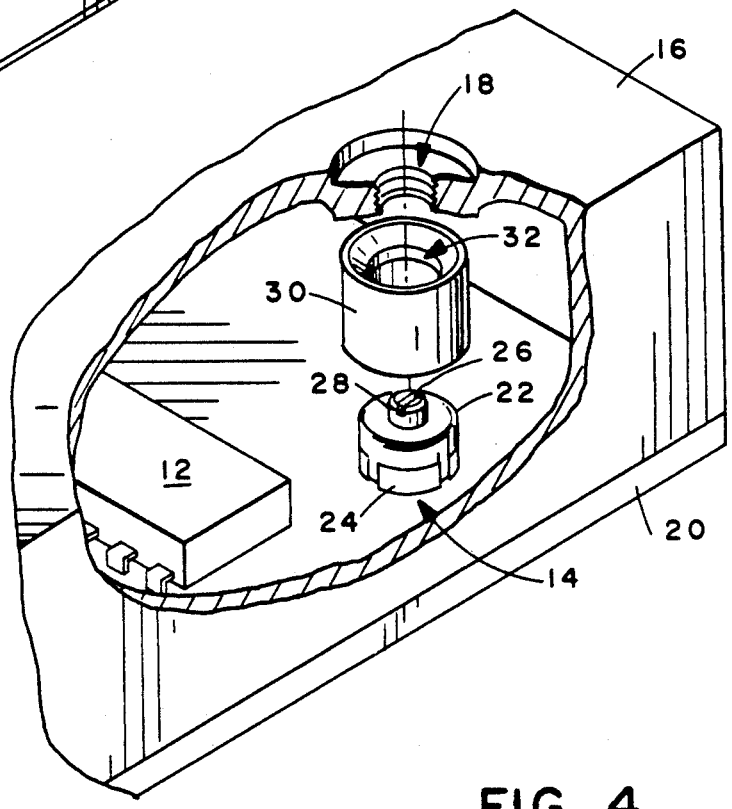
FIG. 2
FIG. 3
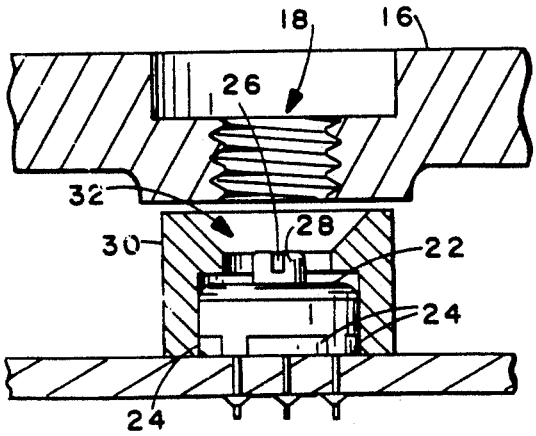
FIG. 4
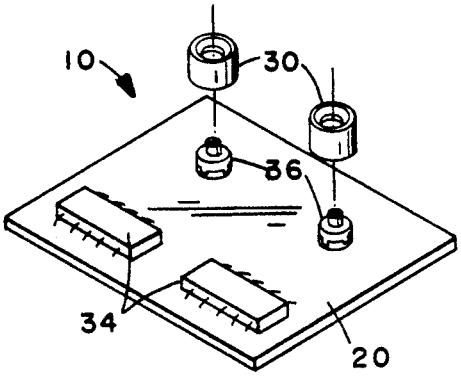

PROTECTIVE CAP FOR ROTATABLY-ADJUSTABLE ELECTRONIC COMPONENTS

FIELD OF THE INVENTION

The invention relates to protective covers for rotary electrical components that are adjustably set with a tool.

BACKGROUND AND SUMMARY OF THE INVENTION

Rotatably adjustable electronic components such variable resistors, capacitors and inductors are well known, as are their many uses in contemporary electronic products. As to rotary resistors, for example, the prior art has utilized various designs as evidenced by the following non-exhaustive examples:

U.S. Pat. No. 4,774,490 to Azuchi, 1988
U.S. Pat. No. 4,649,366 to McDonald, 1987
U.S. Pat. No. 4,206,334 to LaRock, 1980
U.S. Pat. No. 3,760,324 to Baldwin et al, 1973
U.S. Pat. No. 3,748,626 to Maurice, 1973
U.S. Pat. No. 3,470,519 to Hatch, 1969
U.S. Pat. No. 3,413,588 to Ferrell, 1968
U.S. Pat. No. 4,477,606 to Ferrell, 1968
U S. Pat. No. 3,355,693 to Benthuysen et al, 1967
U.S. Pat. No. 3,350,673 to Spaude, 1967
U.S. Pat. No. 3,237,140 to Barden et al, 1966
U.S. Pat. No. 2,829,224 to De Bell, 1958
U.S. Pat. No. 2,745,927 to Daily et al, 1956
U.S. Pat. No. 2,639,358 to Budd et al, 1953

Such components although quite suitable insofar as electrical characteristics are concerned often prove to be rather fragile when used in industrial or other applications where harsh conditions are common. For example, such components may be placed on relatively crowded printed wiring (PW) boards associated with various electronic circuits found in vehicles such as automobiles and motorcycles. In addition to extremes in temperature, humidity, dust and vibration, thus requiring weatherproof housings, the electronic package is often located in relatively inaccessible locations due to space limitations.

Adjusting the rotor positions of such components by way of tools inserted through small access holes in the housings is difficult even when the package containing the components is not remotely located. That is to say, even when the package is visible, the housed component is not necessarily visible, and it is difficult for the technician attempting to adjust the circuit operation to engage the rotor tuning slot with an adjustment tool such as a screwdriver. Repeated attempts to engage the tool with the rotor adjustment assembly by feel or touch leads to repeated impacts on the rotary mechanism and inadvertent contact with other nearby components, thus resulting in mechanical and/or electrical damage to the fragile rotary component body.

Frequent replacement of damaged parts is clearly impractical. Moreover, replacement of parts with more robust physical features is not always possible due to crowded wiring board conditions and size limitations. There, therefore, exists a need in the art to provide a means for guiding the adjustment tool to a rotatably-adjustable resistor or the like, which is not visible from outside the housing, while simultaneously protecting the resistor from blind insertions of the adjustment tool through an access hole in the housing.

I have discovered that a rotatively adjustable electronic component such as a variable resistor may be protected from blind tuning attempts through the use of a plastic cap frictionally secured to the component for the purpose of providing impact protection and mechanical support. Furthermore, the incorporation of a tapered funnel-shaped lead-in port which would surround the tuning slot of the rotary component assists in guiding a blindly inserted adjusting tool into engagement with the tuning slot. Such a self-retaining impact-absorbing cap which is press fit to the body of the rotary component and which additionally provides a means for guiding the adjustment tool for proper engagement with the rotor adjustment means fulfills the above-identified need in the prior art. Moreover, the need is fulfilled while falling well within the size limitations of most applications. That is to say, although an increase in the overall component-cap size is experienced, such an increase is normally much less than that required by available substitute components that have heavier physical features.

As an additional feature, where a plurality of rotatably-adjustable electronic components are included on the printed wiring board, the protective caps as well as the access openings may be color coded to assist in identifying components during tuning procedures performed both in the field and in the factory.

It is, therefore, an object of the present invention to provide a means of protecting a rotatably-adjustable electrical component from damage caused by a blindly-inserted misdirected adjustment tool.

It is a further object of the present invention to provide a tapered, funnel-shaped lead-in hole for guiding the adjustment tool to the tuning slot in the rotatably-adjustable component itself.

It is a further object of the present invention to provide a means of color-coding a plurality of electrical components for selective adjustment by providing a different colored cap covering each electrical component.

BRIEF DESCRIPTION OF THE DRAWINGS

FIG. 1 s a perspective view of the electronic control unit of the preferred exemplary embodiment of the invention;

FIG. 2 is a partial cut-away perspective view of the protective cap in the interior of the electronic control unit of FIG. 1.;

FIG. 3 is a partial cross-sectional view of the cap of FIG. 1 in place under a tuning access hole in a protective housing casting; and;

FIG. 4 is a perspective view of an exemplary wiring board and electrical components of the present invention without a housing.

DETAILED DESCRIPTION OF THE DRAWINGS

Referring to FIG. 1, an electronic control unit 10 such as may be used in various environments such as automobiles and the like, houses electrical components 12, 14 as shown in FIG. 2. Electronic control unit 10 contains a housing 16 for protecting the electrical components from the elements and an access hole 18 for tuning rotatably-adjustable electrical components 14 inside housing 16. Threaded closure means (not shown) may be included in opening 18 to prevent contaminants from entering the housing. Electronic control unit 10 may contain many such rotatably-adjustable components 14 accessible by a like number of access holes 18, and may be located almost anywhere in an environment such as in the engine compartment or the dashboard of an automobile and also may be in any spatial orientation. Accordingly, although access hole 18 is accessible to a user for the insertion of a screwdriver or other adjustment tool for adjusting interior components, such adjustment must be made by "feeling" for the rotor with the adjustment tool.

As previously noted, without the inclusion of my protective cap, the adjustment tool may, through slippage or misalignment, cause mechanical and/or electrical damage to the rotary or other components.

FIG. 2 illustrates the interior of an exemplary electronic control unit 10 with electrical components, such as integrated circuit 12 and rotatably-adjustable variable resistor 14 mounted on a conventional printed wiring (PW) board 20. A protective cap 30, preferably constructed of a material such as acetal plastic, is press fit over flange portions 24 of casing 22 of variable resistor 14.

Protective cap 30 has a tapered, funnel-shaped lead-in port 32 in its center, with the larger diameter end of port 32 located toward access hole 18 in casing 16. Access hole 18 in the housing is substantially in direct axial alignment with both lead-in port 32 in cap 30 and with slot 26 located in the end of rotor tuning shaft 28 of the variable resistor 14.

The size of lead-in port 32 allows some misalignment of elements 18 and 26. Additionally, the tapered funnel shape of the lead-in port aids in the prevention of damage to the variable resistor casing 22 as well as other nearby components and also aids in guiding the end of an adjustment tool toward the tuning slot 26 of variable resistor 14.

Without protective cap 30 in place, inserting an adjustment tool through access hole 18 would leave variable resistor casing 22 and other nearby components open to repeated impacts from the adjustment tool as the user repeatedly attempts to find tuning slot 26. As previously noted, such rotatable components although being quite suitable as to electrical characteristics, are rather fragile and easy to mechanically damage. Thus, protective cap 30 aids both in protecting the component that it covers and also in directing a faster and quicker tuning procedure for the variable resistor 14.

FIG. 3 illustrates in cross section the relationship between access hole 18, tapered lead-in port 32 in protective cap 30 and tuning slot 26 in the end of rotor shaft 28 of the variable electrical element 14. The larger outer end of the tapered lead-in port 32 preferably has a greater diameter than access hole 18 to aid in directing the adjusting tool toward tuning slot 26, as well as allowing some misalignment.

In the exemplary embodiment as shown in FIG. 4, electrical components 34, 36 mounted to PW board 20 in electronic control unit 10 may include several adjustable rotary elements for tuning purposes or the like wherein color coding of the protective caps 30 and the access ports may be included via conventional means such as painting, dyes or markers. In this exemplary embodiment, a plurality of rotatably-adjustable electrical components 36 may each be protected by a protective cap 30 where each cap is molded in a different color, thereby color-coding the caps and the electrical component protected by each cap. This feature is useful for identifying rotatably-adjustable electronic components in following tuning procedures on a PW board.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In an electrical control unit containing one or more rotatably-adjustable electrical components housed in a protective casing having at least one tuning access hole, the improvement comprising:

a protective cap covering at least one of said electrical components, said cap including a tapered lead-in bore through said cap for allowing access to said at least one electrical component through said cap, wherein said lead-in bore is aligned with and adjacent to one of the tuning access holes in the casing.

2. The improvement of claim 1, wherein the cap is secured to at least one of said electrical components by a press fit.

3. The improvement of claim 1, wherein said cap is constructed of an electrically non-conductive material.

4. The improvement of claim 3, wherein said non-conductive material is acetal plastic.

5. The improvement of claims 3 or 4 wherein said cap is color coded.

6. An electrical control unit comprising in combination:

an electrical wiring board, said wiring board containing at least one rotatably-adjustable electrical component;

a housing for enclosing said wiring board, said housing including at least one access opening aligned with a rotor shaft of said electrical component;

a protective cap carried on said electrical component, said cap including a tapered, funnel-shaped lead-in bore which is aligned with said rotor shaft of said electrical component and allows access to said electrical component through said cap.

7. An electrical control unit as in claim 6 wherein said cap is carried by way of a self retaining press fit to the body of said electrical component.

8. An electrical control unit as specified in claim 6 wherein the tapered bore of the cap provides a guiding surface for a component adjustment tool entered through said access opening and said cap protects said component from damage by a misdirected adjustment tool entered through said access opening.

9. An electrical control unit as in claim 6 wherein said cap is constructed of an electrically non-conductive material.

10. An electrical control unit as in claim 9 wherein said material is acetal plastic.

11. An electrical control unit as specified in claim 6 wherein each cap and each access opening is color coded.

12. In an electrical control unit containing a plurality of adjustable electrical components, the improvement comprising:

a plurality of protective caps, each said cap secured to one of said electrical components;

each said cap including a tapered, funnel-shaped lead-in opening and bore aligned with an adjustable element of one of said components, and each said cap having a different color for identification purposes;

whereby said tapered openings provide a guiding surface for a component adjustment tool and said caps protect said components from damage by a misdirected adjustment tool passed through said opening and bore.

13. The improvement of claim 12, wherein each cap is secured to each said electrical component by a press fit.

14. The improvement of claim 12, wherein each said cap is constructed of an electrically non-conductive material.

15. The improvement of claim 14, wherein said non-conductive material is acetal plastic.

* * * * *